US006582316B2

(12) United States Patent
Tompert

(10) Patent No.: US 6,582,316 B2
(45) Date of Patent: Jun. 24, 2003

(54) METHOD AND DEVICE FOR DEVELOPING ACCURATE AIM

(76) Inventor: Paul A. Tompert, 3109 E. Covina, Mesa, AZ (US) 85213

( * ) Notice: Subject to any disclaimer, the term of this patent is extended or adjusted under 35 U.S.C. 154(b) by 2 days.

(21) Appl. No.: 09/923,104

(22) Filed: Aug. 6, 2001

(65) Prior Publication Data

US 2003/0027650 A1 Feb. 6, 2003

(51) Int. Cl.[7] ..... A63D 15/00; A63D 15/20; A63B 67/00

(52) U.S. Cl. ..... 473/2; 473/1; 473/17; 473/52; 273/317.1; 273/348; 273/127 R

(58) Field of Search ..... 273/317.1, 348, 273/127 R

(56) References Cited

U.S. PATENT DOCUMENTS

| | | | | |
|---|---|---|---|---|
| 3,843,120 A | * | 10/1974 | Ricci | 473/2 |
| 3,947,026 A | | 3/1976 | Scoutten | |
| 3,948,522 A | * | 4/1976 | Fixler | 463/50 |
| 3,972,532 A | * | 8/1976 | Bradley | 473/140 |
| 4,178,694 A | | 12/1979 | Bonney | |
| 4,524,969 A | | 6/1985 | Erzmoneit | |
| 4,948,128 A | | 8/1990 | Emery, II et al. | |
| 5,154,415 A | | 10/1992 | Zotos | |
| 5,322,475 A | | 6/1994 | Irvin | |
| 5,584,768 A | * | 12/1996 | Lee | 473/190 |
| 5,885,165 A | * | 3/1999 | Krause | 473/200 |
| 6,045,450 A | | 4/2000 | Cyr | |
| 6,132,319 A | * | 10/2000 | Schluter | 473/2 |

* cited by examiner

*Primary Examiner*—Paul T. Sewell
*Assistant Examiner*—Mitra Aryanpour

(57) ABSTRACT

An accuracy development device is disclosed, including a simulated projectile coupled to a feedback mechanism. The feedback mechanism provides feedback indicating whether a desired impact point on the simulated projectile has been hit by a free projectile propelled toward it. In one embodiment, the desired impact point may be a sensor that is coupled to the feedback mechanism. The simulated projectile may be fixed to a contact location on a base such that the simulated projectile may not be moved in a translational sense but so that it may be rotated about an axis that extends through the contact location and the simulated projectile and is substantially perpendicular to the base. The desired impact point may thus be moved to a variety of different positions with respect to the free projectile, allowing the invention to be used for accuracy development from setups having a wide variety of initial conditions.

1 Claim, 3 Drawing Sheets

METHOD AND DEVICE FOR DEVELOPING ACCURATE AIM

BACKGROUND OF THE INVENTION

1. Technical Field

This invention generally relates to dual- or multiple-projectile targeting games, and more specifically relates to a method and device for developing accurate aim in such games.

2. Background Art

There are many games and activities that involve propelling a ball or other projectile at a target. Relatively few of these games require a participant to propel a first projectile toward a second projectile in an attempt to move the second projectile toward a target. As used herein, the description "dual- or multiple-projectile targeting games" is used to describe games where this latter endeavor is the object. Billiards and marbles are just two examples of these dual- or multiple-projectile targeting games. Other similar games may also exist. While the following discussion may focus on billiards, it will be understood that the invention described herein may be used in connection with any dualor multiple-projectile targeting game or activity.

Billiards is a term used to refer to any of several games played on a table with a designated number of balls and a long stick called a cue. Many, but not all, billiard tables have pockets in various locations into which certain of the billiard balls are to be propelled in a manner that varies with the type of billiards game being played.

One of the challenges of many conventional forms of billiards is that instead of aiming and propelling a ball directly toward a target—which may be, for example, one of the pockets referred to above—a first ball must generally be propelled toward a second ball in an attempt to impact it in such a way as to propel that second ball toward the target. Because the direction a ball moves is determined almost entirely by where it is impacted, a successful billiards player must correctly aim one ball at another, and accurately strike the first ball such that it hits a very specific desired impact point on the second ball. Since the angles between the two balls and the target can vary so widely, acquiring the skills described above can be rather difficult.

A player's aim and accuracy can, however, often be improved with practice. There are several inventions that seek to aid in this process. Many such inventions involve templates or similar devices, designed to be placed on a billiard table or billiard ball, that indicate correct trajectories, impact points, or striking locations. The existing inventions, however, are problematic in that they do not give clear feedback as to whether a particular point on the impacted ball has been hit. Further drawbacks of the existing devices are that they may involve potentially undesirable markings on the game equipment, or may involve placing an item on the table that either affects the trajectory of the ball or that must be removed before a shot is attempted, thus deviating from actual game conditions.

SUMMARY OF THE INVENTION

Therefore, there exists a need for a method and device adapted to develop the aim and accuracy useful in dual- or multiple-projectile targeting games, such as billiards or marbles. The present invention provides an accuracy development device including a simulated projectile, so called because it differs from a conventional projectile in ways that will be explained below, coupled to a feedback mechanism that provides feedback indicating whether a desired impact point on the simulated projectile has been hit by a free projectile propelled toward it by a cue stick or other means. The desired impact point may be a sensor coupled to the feedback mechanism.

Both billiards and marbles conventionally are played with balls, i.e., spherical projectiles, on a substantially flat surface. One such spherical projectile—the struck projectile—may be made to move in a variety of directions by striking it at particular points on its surface with another spherical projectile—the striking projectile. For example, to move the struck projectile along the same line traveled by the striking projectile, the striking projectile must hit the struck projectile squarely in its center. To move the struck projectile along some other path, an off-center impact is necessary. The invention described herein may assist a user of the invention with the successful placement of such impacts at particular desired impact points, where the impact points are selected based on the desired final destination of the struck projectile.

The simulated projectile of the present invention may be fixed to a contact location on a base such that the simulated projectile may not be moved in a translational sense but so that it may be rotated about an axis that extends through the contact location and the simulated projectile and is substantially perpendicular to the base. The desired impact point may thus be moved to a variety of different positions with respect to the free projectile, allowing the invention to be used for the development of accuracy with shots of all angles and types.

In one embodiment of the invention, the feedback mechanism may be electronic, and may provide feedback that is visual, audible, or detectable in some other way. Feedback mechanisms of other forms, or that provide feedback of other descriptions, are also possible. The base of the invention may be provided with a substantially flat runway adjacent to one or more channels into which the free projectile may fall after impacting the simulated projectile. Such a channel may allow the free projectile to roll or slide to a location within reach of the user of the invention. The invention allows a user to develop needed accuracy even when a billiards table is not available, and because in at least one embodiment the invention is portable, the required skills may be developed almost anywhere.

BRIEF DESCRIPTION OF THE DRAWINGS

The foregoing and other features and advantages of the invention will be apparent from the following more particular description of specific embodiments of the invention, as illustrated in the accompanying drawings, wherein.

DETAILED DESCRIPTION OF EMBODIMENTS OF THE INVENTION

The present invention provides an accuracy development device including a simulated projectile coupled to a feedback mechanism that provides feedback indicating whether a desired impact point on the simulated projectile has been hit by a free projectile propelled toward it. The desired impact point may be a sensor coupled to the feedback mechanism.

As has been explained, billiards differs from other targeting games and activities in that the projectile being propelled is not sent directly toward the ultimate target. In billiards, as conventionally played, a first ball, often called a cue ball, must be struck with a cue in such a way as to cause the first ball to impact a second ball, sending the second ball into a target such as a pocket on the table. The second ball may be referred to as the object ball. The manner in which the cue ball is struck, and the location at which the object ball is hit by the cue ball, thus become important to success in the game.

Figure 1:
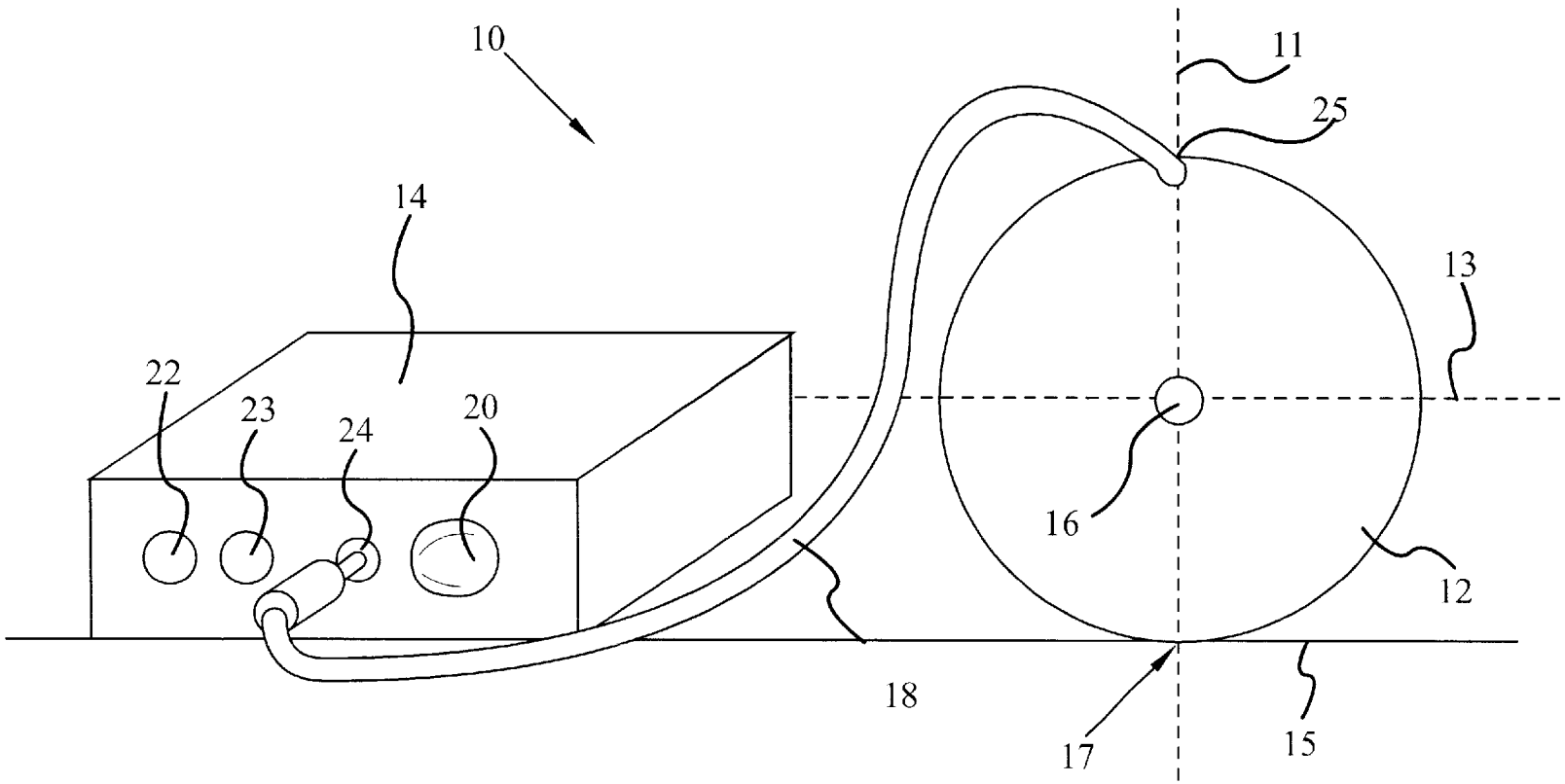
FIG. 1 is a perspective view of an accuracy development device configured according to an embodiment of the present invention.

Referring now to the figures, and in particular to FIG. 1, an accuracy development device 10 includes a simulated projectile l2 and a feedback mechanism 14. Simulated projectile 12 contacts a surface 15 at a contact location 17. A crown 25 is the point on simulated projectile 12 directly opposite contact location 17. A sensor cap 16, part of a sensor 49 (see FIG. 3) is located in simulated projectile 12. In one embodiment, sensor cap 16 lies on an equator 13 of simulated projectile 12. A wire 18 couples simulated projectile 12 to feedback mechanism 14. An input 24 in feedback mechanism 14 receives wire 18. Feedback mechanism 14 may include a light 20 and an audio indicator 22, as well as auxiliary feedback indicator 23. Auxiliary feedback indicator 23 may for example comprise a counter that could keep track of the number of successful hits, or a timer that could provide feedback regarding the amount of time taken to perform certain activities.

In conventional billiards, a cue ball may be struck with a cue to send the cue ball into an object ball, which then is also propelled to a new position. The cue ball corresponds to a free projectile 34, shown in FIG. 2. In the present invention, simulated projectile 12 corresponds to the object ball, yet, in at least one embodiment, does not possess full freedom of movement, as has been explained. The word "simulated" is used to highlight the fact that simulated projectile 12, while it may be similar in appearance to a conventional billiard ball, differs in at least that respect. Thus, the term "simulated projectile" as used herein means a projectile that has the appearance of a standard projectile but that is fixed to a particular contact location and may not be moved in a translational sense. It may also be modified in other ways, as described below. The word "projectile" herein means an object that in the conventional course of its use is propelled from one point to another. "Free projectile" means a projectile that is free to move in any direction, just as a projectile would be in a conventional billiards game.

Simulated projectile 12 may be fixed at contact location 17 on surface 15 such that simulated projectile 12 may not be moved in a translational sense. Translational motion means the motion of a body in which every point of the body moves parallel to and the same distance as every other point of the body. Fixing simulated projectile 12 to contact location 17 in this manner means that projectile 12 need not be retrieved and set in place each time it is hit. Rather, it stays in place regardless of the number of times or the manner in which it is hit, thus contributing to ease of use of accuracy development device 10.

Although it may be fixed in a translational sense as described, simulated projectile 12 may, in certain embodiments of the invention, be capable of rotation about an axis 11. Axis 11 may extend through simulated projectile 12, contact location 17, and surface 15 and be substantially perpendicular to surface 15. By rotating simulated projectile 12, sensor cap 16 may be brought to a variety of positions suitable for developing accuracy and practicing aim. In an embodiment of the invention where sensor cap 16 lies on equator 13, the number of suitable positions for sensor cap 16 may be maximized. Equator 13 is meant to refer herein to a line approximately midway between contact location 17 and crown 25 and substantially parallel to surface 15.

The phrase "suitable positions" herein means those positions of sensor cap 16 where cap 16 is accessible to and may be struck by free projectile 34 traveling along surface 15. In one embodiment, both simulated projectile 12 and free projectile 34 are billiard balls. Alternatively, the projectiles may possess certain characteristics of real billiard balls, such as size, shape, and mass, but be modified in some respects, such as by having sensing devices placed within them. It will also be readily understood by one of ordinary skill in the art that other sizes, masses, shapes and other characteristics are also possible. For example, projectiles 12 and 34 may be larger or smaller than standard billiard balls. Additionally, they may have any shape, in addition to spherical, suitable for travel along surface 15.

When they collide, spherical projectiles make contact over a relatively small area of their surfaces. As is readily apparent to one of ordinary skill in the art, two such projectiles of equal size, constrained to stay on the same surface, may make contact only at their equators. It is for this reason that locating sensing cap 16 on equator 13 maximizes the number of suitable positions for cap 16. It will be equally clear that any point on simulated projectile 12 not on equator 13 will be unreachable by a spherical projectile moving on the same surface 15 on which projectile 12 is located.

Sensor cap 16 may protrude very slightly from simulated projectile 12 so that when cap 16 is struck, for example by free projectile 34, it may be pushed temporarily toward the surface of simulated projectile 12. This movement may cause electrical contact to be made inside sensor 49, in a manner that will be further described in connection with FIG. 3. When such electrical contact is made, feedback mechanism 14 may indicate the successful impact using, for example, light 20 or audio indicator 22.

The less sensor cap 16 protrudes from simulated projectile 12, the more closely an impact made using accuracy development device 10 replicates an impact made in a conventional billiards game. Non-protruding sensors that lie flush with the surface of projectile 12 may also be used. The inventor has discovered, however, that non-protruding sensors may be prone to indicate a successful hit when in fact none has been made. Such false results may be the result of the sensor being jarred by the force of an impact. Protruding sensors, with sensor caps adapted to be moved in and out of the sensor, seem to be less prone to this problem.

The details of sensor cap 16 depend in part on the features of sensor 49, of which sensor cap 16 is a part. In one embodiment, a plurality of sensor caps 16 may be thickly distributed around equator 13, or concentrated in some other section or area of simulated projectile 12. Each sensor cap 16 could be coupled to feedback mechanism 14 such that a user of device 10 could know not only whether a desired impact point had been hit or missed, but which particular point on the surface of simulated projectile 12 had been hit.

Feedback mechanism 14 may be any mechanism that conveys to a user information indicating whether sensor cap 16 has been hit. In at least one embodiment of the invention, feedback mechanism 14 is electronic, and comprises electronic circuitry coupled to a power supply, not shown, and to sensor 49 located within or partially within simulated projectile 12. The word "electronic," as used herein, means a device that operates on principles governing the behavior of electrons. This feedback may be visual, as exemplified by light 20, or audible, as exemplified by audio indicator 22. In addition, any other type of feedback perceptible to a user of accuracy development device 10 may also be used. For example, one embodiment of the invention may include an attachment connected to a user's body that gives tactile feedback when sensor cap 16 is hit. These additional types of feedback may be manifested with the aid of auxiliary feedback indicator 23.

Wire 18 may be any coupling apparatus capable of transmitting electronic signals. Sensor 49 in simulated projectile 12 may transmit electronic signals to feedback mechanism 14 as a result of an impact on sensor cap 16. As will be explained below, such an impact may complete a circuit between a feedback indicator such as light 20, and a power supply such as a battery, not shown, within feedback mechanism 14. This may happen inside sensor 49, as an impact depresses sensor cap 16 and causes it to force formerly-separated electronic circuit components not shown, within sensor 49 to come into contact.

Figure 2:
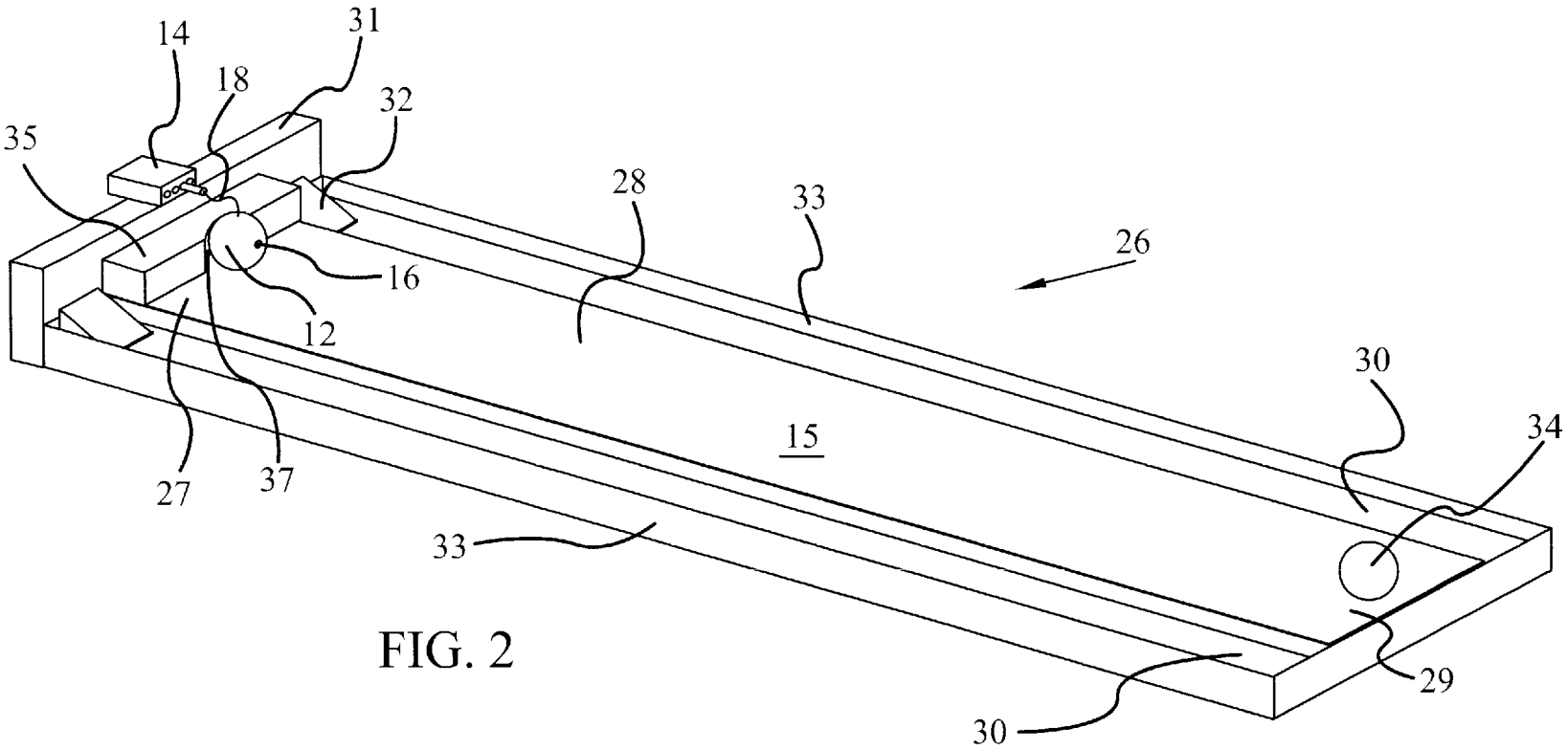
FIG. 2 is a perspective view of an accuracy development device configured according to another embodiment of the present invention.

Referring now to FIG. 2, a base 26 may include a first end 27, a runway 28, a second end 29, channels 30, and ramps 32. Simulated projectile 12 may be attached to base 26 near first end 27, and free projectile 34 may be placed near second end 29. Base 26 may in one embodiment include an elevated platform 31 on which feedback mechanism 14 may rest or be attached, such as with velcro strips, not shown. Alternatively, feedback mechanism 14 may be placed or attached to some other location, as permitted by the extent of wire 18, which may have any length desired. A brace 35 may be attached to base 26 between simulated projectile 12 and first end 27. Runway 28 includes surface 15 to which the activities of simulated projectile 12 and free projectile 34 are largely confined. Base 26 is flanked by sidewalls 33.

Base 26 may be constructed of any of a wide variety of materials, with plywood being only one possibility. It may advantageously be made longer than it is wide, thus allowing shots of a length and type conventional in billiards. In addition, base 26 may be constructed so as to be portable. This may include providing one or more hinges or series of hinges, not shown, placed either along the length or the width of base 26, to allow device 10 to be folded for storage or transport. A handle, also not shown, may be provided for convenience in carrying or otherwise transporting a foldable or non-foldable accuracy development device 10. Various sizes of device 10 may be employed, selected based on the intended use as well as the intended location of use.

Surface 15 of runway 28 may be smooth and flat so as to provide a location in which projectile 34 may travel a substantially undeviating course in the direction it is originally propelled. Channels 30 may act as pathways along which free projectile 34 may return toward second end 29. Projectile 34 may be confined to channel 30 by sidewall 33 on one side and runway 28 on the other. Ramp 32, when located near simulated projectile 12 and first end 27, may guide free projectile 34, after it impacts simulated projectile 12, into channels 30. Brace 35 serves to stabilize and support simulated projectile 12, and may be bolted or otherwise attached to base 26. A concave surface 37 of brace 35 may in one embodiment cup simulated projectile 12.

In use, free projectile 34 is placed on runway 28 near second end 29. Simulated projectile 12 is rotated in such a way as to position sensor cap 16 at the desired impact point. Free projectile 34 is then propelled along runway 28, perhaps by striking projectile 34 with a cue as is conventional for billiards, but possibly in some other manner. After free projectile 34 completes its motion in the direction of simulated projectile 12, the feedback from feedback mechanism 14 is analyzed in order to determine if adjustments to the foregoing accuracy development procedure are necessary. As has been mentioned, such feedback, such as from a light or a buzzer, indicates whether sensor cap 16, located at the desired impact point, has been hit. In one embodiment, the illumination of light 20, or the sounding of audio indicator 22, indicates a successful impact, although other styles and forms of feedback are also possible. The preceding steps may be repeated as often as desired.

Figure 3:
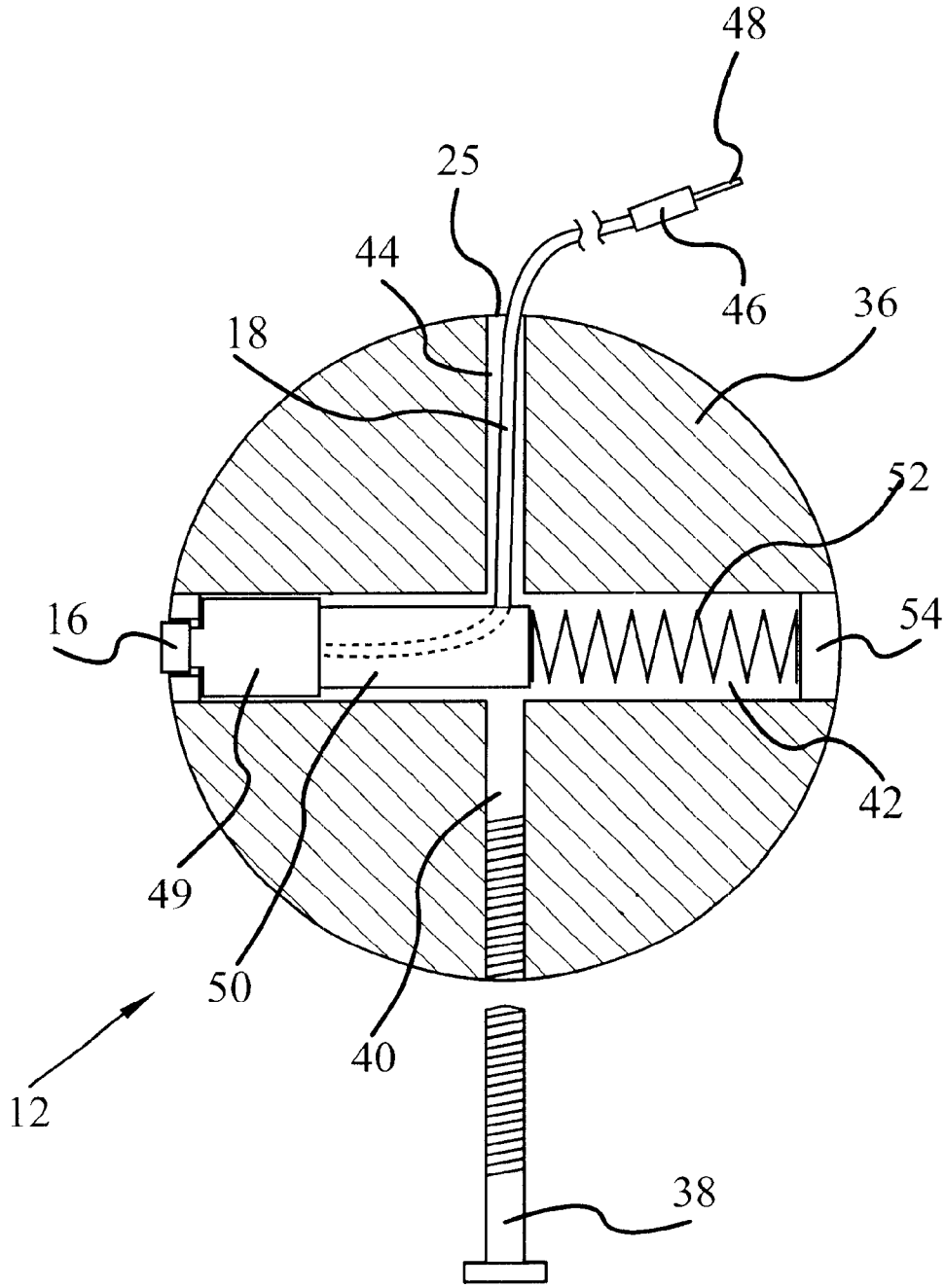
FIG. 3 is a sectional view of a simulated projectile according to an embodiment of the present invention.

As indicated in FIG. 3, simulated projectile 12 has a first hemisphere 36. Hemisphere 36 may have a threaded passageway 40, a sensor passageway 42, and a wire passageway 44. Hemisphere 36 may also include additional components that work with or form part of feedback mechanism 14 to produce feedback indicating whether a desired impact point has been hit.

In one embodiment of the invention, for example, sensor passageway 42 may contain sensor 49, and wire passageway 44 may contain wire 18. Passing wire 18 through wire passageway 44 allows wire 18 to exit simulated projectile 12 at or near crown 25. This placement separates by a convenient amount wire 18 from sensor cap 16, and may help prevent interference between the two. Wire 18 may terminate in a housing 46 topped by a prong 48, a construction that will be recognized as conventional by one of ordinary skill in the art. Prong 48 may be suitable for insertion into input 24, shown in FIG. 1. Threaded passageway 40 may be used to screw simulated projectile 12 onto a bolt 38, which may be attached to base 26 near first end 27. Any other attachment means may also be used to fix simulated projectile 12 to base 26. Adhesive tape, glue, or brackets are examples of such alternate attachment means.

Threaded passageway 40, along with sensor passageway 42 and wire passageway 44, may be cylindrical passages bored into simulated projectile 12. Passageways 40 and 44 may extend from substantially opposite points on the surface of simulated projectile 12 toward the center of projectile 12, and may terminate at or near sensor passageway 42. Passageway 42 may pass through projectile 12 such that it is substantially perpendicular to passageways 40 and 44. Sensor passageway 42 may extend completely through simulated projectile 12. A plug 54 may be provided to close and conceal one end of sensor passageway 42.

Sensor passageway 42 may in one embodiment contain a bushing 50 and a spring 52, in addition to sensor 49 and plug 54. Sensor 49 may be any sensing device capable of detecting whether a desired impact point on simulated projectile 12 has been hit. In one embodiment, sensor 49 contains internal pins, not shown, that are pushed, when sensor cap 16 is depressed by pressure from free projectile 34, into contact with internal contact points, also not shown, in a conventional manner. An embodiment of accuracy development device 10 is adapted to allow sensor 49 to move as a body farther into simulated projectile 12 after sensor cap 16 has moved enough to send the pins into the contacts inside sensor 49. This adaptation may help prevent damage to sensor 49. Spring 52 may push against plug 54 in order to return sensor 49 to its original position after it has been moved as described. Bushing 50 may provide further support for sensor 49. Bushing 50 may also contribute to proper spacing among the components located within sensor passageway 42.

The foregoing description has described selected embodiments of a method and device adapted to develop the aim and accuracy useful in billiards and other dual- or multiple-projectile targeting activities. The device includes a simulated projectile coupled to a feedback mechanism that provides feedback indicating whether a desired impact point on the simulated projectile has been hit by a free projectile propelled toward it by a cue stick or other means. The desired impact point is in one embodiment a sensor coupled to the feedback mechanism.

While the invention has been particularly shown and described with reference to specific embodiments thereof, it will be understood by those skilled in the art that, limited only by the appended claims, various changes in form and details may be made therein without departing from the spirit and scope of the invention.

I claim:

1. A device adapted to develop accurate aim in dual- or multiple-projectile targeting activities, said device comprising:

(1) a simulated projectile including a desired impact point, said desired impact point comprising a sensor, said simulated projectile comprising a billiard ball;

(2) an electronic feedback mechanism coupled to, and at least partially contained within, said simulated projectile, said feedback mechanism producing feedback indicating whether said desired impact point has been hit, wherein said feedback is at least one of a visual and an audible indication;

(3) a base comprising a runway and at least one channel adjacent to said runway, said simulated projectile fixed to a contact location on said base such that said simulated projectile may not be moved in a translational sense, said simulated projectile adapted to rotate about a fixed axis extending through said contact location and said simulated projectile, said axis substantially perpendicular to said base; and (4) a free projectile adapted to be propelled toward said simulated projectile, said free projectile comprising a billiard ball of substantially the same shape and size as said simulated projectile.

* * * * *